US007891218B2

(12) United States Patent
Shikamori et al.

(10) Patent No.: US 7,891,218 B2
(45) Date of Patent: Feb. 22, 2011

(54) DRAIN SYSTEM OF DRUM-TYPE WASHING MACHINE

(75) Inventors: Tamotsu Shikamori, Changwon-si (KR); Dong Beom Lee, Changwon-si (KR); Jong Seog Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 580 days.

(21) Appl. No.: 10/552,959

(22) PCT Filed: May 30, 2005

(86) PCT No.: PCT/KR2005/001607

§ 371 (c)(1),
(2), (4) Date: Dec. 12, 2006

(87) PCT Pub. No.: WO2005/118939

PCT Pub. Date: Dec. 15, 2005

(65) Prior Publication Data

US 2007/0137265 A1 Jun. 21, 2007

(30) Foreign Application Priority Data

Jun. 1, 2004 (KR) ..... 10-2004-0039574
Jun. 1, 2004 (KR) ..... 10-2004-0039575
Jun. 1, 2004 (KR) ..... 10-2004-0039583

(51) Int. Cl.
*D06F 37/00* (2006.01)
*D06F 39/00* (2006.01)

(52) U.S. Cl. ..... 68/208; 68/3 R

(58) Field of Classification Search ..... None
See application file for complete search history.

(56) References Cited

U.S. PATENT DOCUMENTS 3,997,292 A * 12/1976 Lutes et al. ..... 8/158

(Continued)

FOREIGN PATENT DOCUMENTS

CN 2425111 Y 3/2001

(Continued)

OTHER PUBLICATIONS

Choi, Seong Bong, Aug. 2001, KR 1020010073574A, English machine translation.*

(Continued)

*Primary Examiner*—Michael Barr
*Assistant Examiner*—Jason Y Ko
(74) *Attorney, Agent, or Firm*—McKenna Long & Aldridge LLP

(57) ABSTRACT

Object of the present invention is to provide a drum type washing machine having a new drain system, which can eliminate inconvenience of user to squat down for mounting/dismounting a drain filter, and damage to electric components following overflow of washing water during water supply.

To achieve above object, the present invention provides a drum type washing machine including an outer case, a tub in the outer case having a drain hole at a lowest portion, and an overflow hole at a predetermined position of an upper portion, a drum rotatably mounted in the tub, a driving motor for transmission of power for rotating the drum through a rotation shaft connected to the drum, a filter case mounted on a front of the outer case, a drain pipe connected between the drain hole in the tub and the filter case for draining water from an inside of the tub toward the filter case, a drain valve mounted to control drainage of washed water, rinsed water, extracted water, condensing water in drying from the tub through the drain pipe, a drain filter between a drain inlet and a drain outlet in the filter case, and a drain hose connected to the drain outlet in the filter case for draining water from the filter case to an outside of the washing machine.

31 Claims, 9 Drawing Sheets

U.S. PATENT DOCUMENTS

| | | | | | |
|---|---|---|---|---|---|
| 5,042,276 | A | * | 8/1991 | Kamano et al. | 68/12.04 |
| 5,645,732 | A | * | 7/1997 | Daniels | 210/747 |
| 5,653,870 | A | * | 8/1997 | Tsuchiya et al. | 210/232 |
| 5,660,063 | A | * | 8/1997 | Lee et al. | 68/18 F |
| 2002/0116960 | A1 | * | 8/2002 | Nakada | 68/18 F |

FOREIGN PATENT DOCUMENTS

| | | | | |
|---|---|---|---|---|
| CN | 2492576 | Y | | 5/2002 |
| EP | 222 264 | A2 | | 5/1987 |
| EP | 481 442 | A2 | | 4/1992 |
| GB | 887811 | A | | 1/1962 |
| GB | 958 843 | A | | 5/1964 |
| JP | 10-295977 | | | 11/1998 |
| JP | 2002248297 | A | * | 9/2002 |
| JP | 2005253990 | A | * | 9/2005 |
| KR | 10-2001-0073574 | | | 8/2001 |

OTHER PUBLICATIONS

Nakada, Kazuo, Sep. 2002, JP 2002-248297A, English machine translation.*

Komori et al., Sep. 2005, JP 2005-253990, English machine translation.*

* cited by examiner

DRAIN SYSTEM OF DRUM-TYPE WASHING MACHINE

This application claims priority to International Application No. PCT/KR2005/001607 filed on May 30, 2005, as well as Korean Applications P 2004-39574 filed on Jun. 1, 2004, P 2004-39575 filed on Jun. 1, 2004, and P 2004-39583 filed on Jun. 1, 2004, all of which are incorporated by reference, as if fully set forth herein.

TECHNICAL FIELD

The present invention relates to drum type washing machines, and more particularly, to a new drain system of a drum type washing machine, which can eliminate inconvenience of user to squat down for mounting/dismounting a drain filter, and damage to electric components following overflow of washing water during water supply.

BACKGROUND ART

Currently, in purchasing a domestic washing machine, not only a washing performance, but also convenience of use are very important product purchasing factors. According to this, development of products is accelerated for enhancing the convenience of use.

In the meantime, though drum type washing, washing laundry by using a friction force between a drum rotated by a driving power of a motor and laundry in a state detergent, washing water, and the laundry are introduced into the drum, shows almost no damage to, and entangling of the laundry, and has pounding, and rubbing washing effects, the drum type washing has inconvenience in introduction/taking out laundry, for improving which technologies are under development.

An exemplary related art drum type washing machine will be described briefly with reference to FIGS. 1 and 2.

FIG. 1 illustrates a section of a related art drum type washing machine, provided with a tub 2 in an outer case 1 supported with dampers 22 and hanging springs 21, a cylindrical drum 3 rotatably mounted in the tub 2, and a driving motor 4 in rear of the tub 2 for receiving power to generate rotating force.

The driving motor 4 has a stator fixedly secured to a rear wall portion of the tub 2 directly, and a rotor mounted on an outer side of the stator, wherein there is a rotation shaft 400 designed to rotate together with the drum, and directly connected to the rotor for direct transmission of the driving force of the rotor to the drum 3.

Over the door 5, there is a control panel 23 for receiving operational instruction from the user and controlling entire operation of the washing machine.

On a front of the outer case 1, there is a door 5 mounted thereon. Between the door 5 and the tub 2, there is a gasket 25.

Moreover, on the outer case 1, there is a door lock switch assembly 15 for locking the door.

The door lock switch assembly 15, having solenoid and plunger for moving back and forth depending on application of power to the solenoid to lock or unlock the door, is known, detailed description of which will be omitted as it is disclosed in Korea Patent Application No. 2000-0002202 (Publication No. P2001-0073574).

The hanging springs 21 are between an inside of an upper surface of the outer case 1 and an upper portion of an outside circumference of the tub 2 for hanging the tub, and the dampers 22 are between a lower portion of an outside circumference of the tub 2 and a lower surface of the outer case 1, for damping vibration of the tub 2 occurred during spinning.

In the meantime, at a lower portion of the front of the outer case 1, there is a lower cover cap 24 mounted thereon, inside of which a pump assembly is mounted, having a filter housing 26 with a filter therein for filtering fluffs and other foreign matters from washing water, and a drain pump 27 for discharging filtered washing water.

At an outlet side of the pump assembly, there is a drain hose 10 connected thereto for guiding the washing water pumped by the drain pump 27 to be discharged to an outside of the washing machine.

However, the foregoing related art drum type washing machine has a drawback in that the user is required to squat down to dismount the filter in cleaning the filter 9*a*, which is not convenient.

That is, there has been difficulty in dismounting the filter because the user is required to squat down, open the lower cover cap 24 with a coin or the like, and, again, open a tight cap with a hand, for taking out the filter from the filter housing 26.

Even in mounting the drain filter, the user is required to undergo the same inconvenience of the squatting down.

That is, the related art drum type washing machine shown in FIG. 1 has a drawback of impairing product reliability due to user's inconvenience in mounting/dismounting the drain filter.

Particularly, for child safety, the related art drum type washing machine has the lower cap 24 designed hard to open with a bare hand.

As a result of this, there has been much trouble and inconvenience in dismounting the drain filter, such that the lower cover cap 24 can be opened by turning up the lower cover cap 24 with a coin or the like with difficulty in a state the user squats down with inconvenience, and, even if the cover cap 24 is opened, the filter can be taken out after the filter cap is opened by turning the filter cap with difficulty.

DISCLOSURE

Technical Problem

An object of the present invention is to provide a drum type washing machine having a new drain system which can solve the problems of user's inconvenience of squatting down/standing up in mounting/dismounting a drain filter, difficulty in opening a lower cover cap and a filter cap in taking out a drain filter in a related art drum type washing machine, and damage to electric components caused by overflow of washing water when a fault is occurred.

Another object of the present invention is to provide a drum type washing machine, in which a structure is provided for mounting a filter case at a center, or one of opposite sides of a front of an outer case, enabling to enlarge a scope of selection in shapes or lengths of the filter case, and vary an overall exterior appearance of the drum type washing machine.

Technical Solution

To achieve above object, the present invention provides a drum type washing machine including an outer case, a tub in the outer case having a drain hole at a lowest portion, and an overflow hole at a predetermined position of an upper portion, a drum rotatably mounted in the tub, a driving motor for transmission of power for rotating the drum through a rotation shaft connected to the drum, a filter case mounted on a front of the outer case, a drain pipe connected between the drain hole in the tub and the filter case for draining water from an inside of the tub toward the filter case, a drain valve mounted to control drainage of washed water, rinsed water, extracted water, condensing water in drying from the tub through the drain pipe, a drain filter between a drain inlet and a drain outlet in the filter case, and a drain hose connected to the drain outlet in the filter case for draining water from the filter case to an outside of the washing machine.

Advantageous Effects

Different from the related art drum type washing machine in which the user is required to squat down for opening the lower filter cap, and taking out the filter, the drum type washing machine of the present invention permits to take out the drain filter standing of a floor, providing convenience of use to the user, a product reliability can be enhanced.

The greater drum height than the related art enabled by the taller filter case permits the user to introduce/take out laundry through the door without bending, but just stretching a hand.

The drum type washing machine of the present invention can solve the problem of damage to electric components caused by overflow of the washing water in a faulty condition, thereby enhancing product reliability.

The possibility of mounting the filter case at a middle, or one of opposite sides of the front of the outer case expands a width of selection from shapes, lengths, and so on of the filter case, and permits to vary an overall outer appearance.

BEST MODE

Embodiments of the present invention will be described in detail with reference to the attached drawings 3 to 9.

Figure 1:
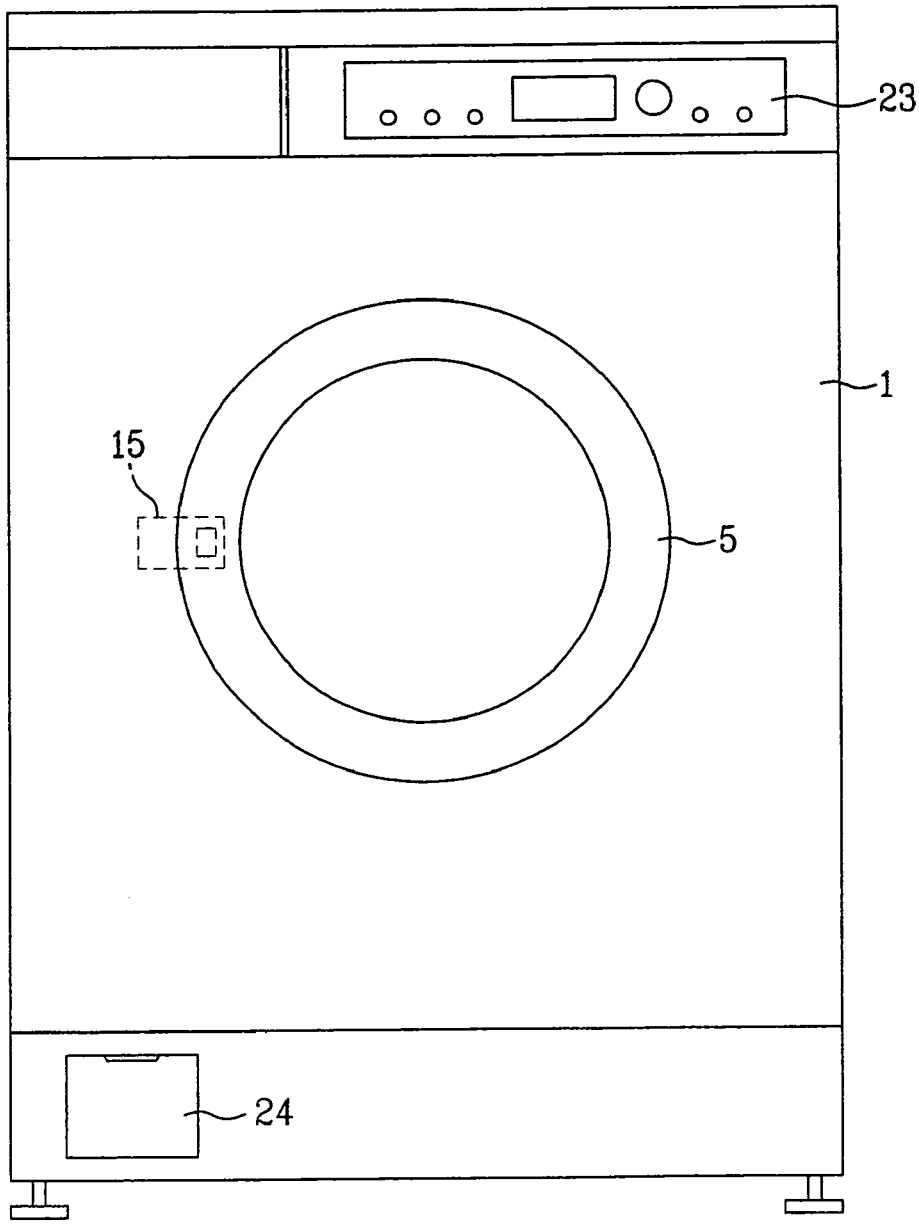
FIG. 1 illustrates a front view of one exemplary related art drum type washing machine.
Figure 2:
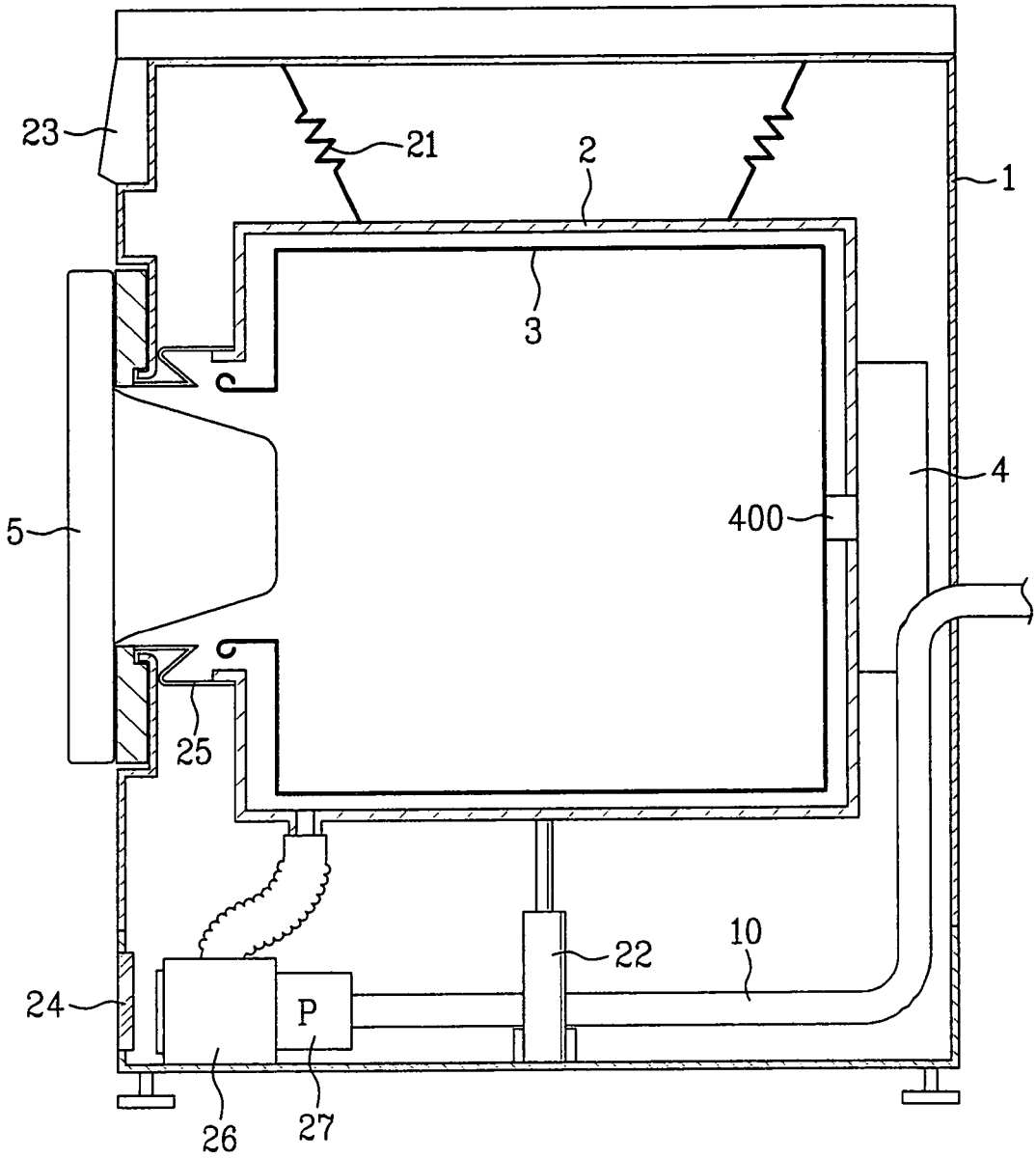
FIG. 2 illustrates a side section of the related art drum type washing machine in FIG. 1.
Figure 3:
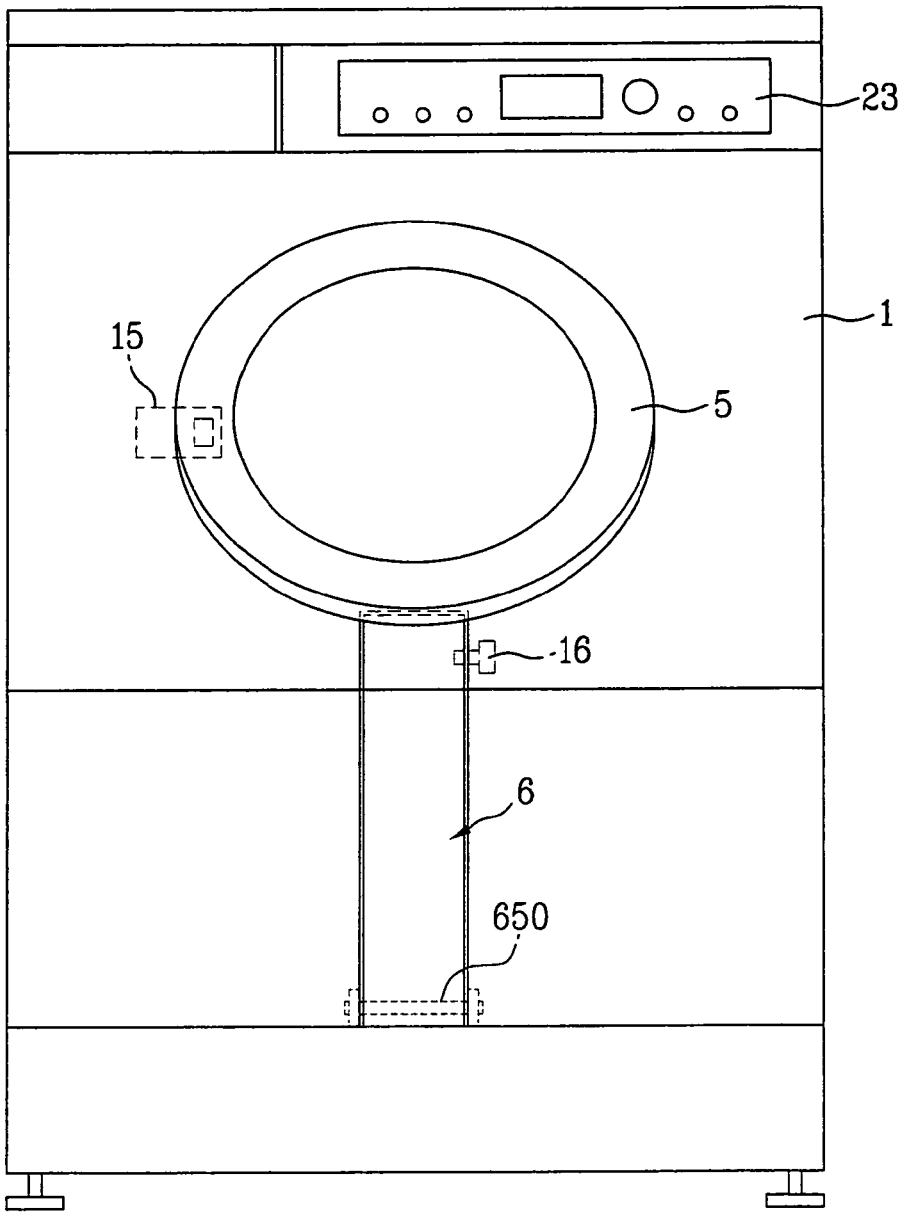
FIG. 3 illustrates a front view of a drum type washing machine in accordance with a first preferred embodiment of the present invention.
Figure 4:
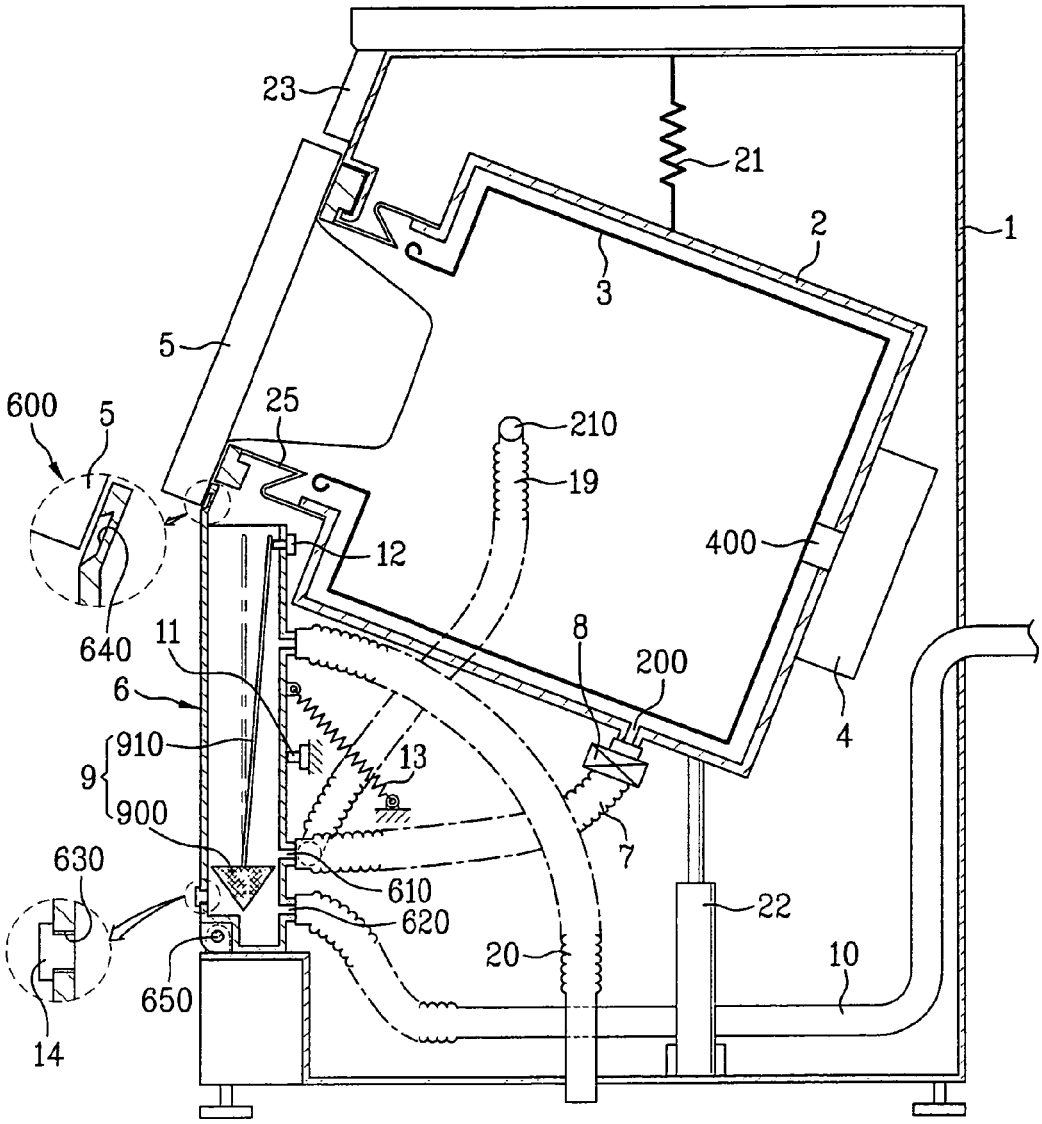
FIG. 4 illustrates a side section of FIG. 3.
Figure 9:
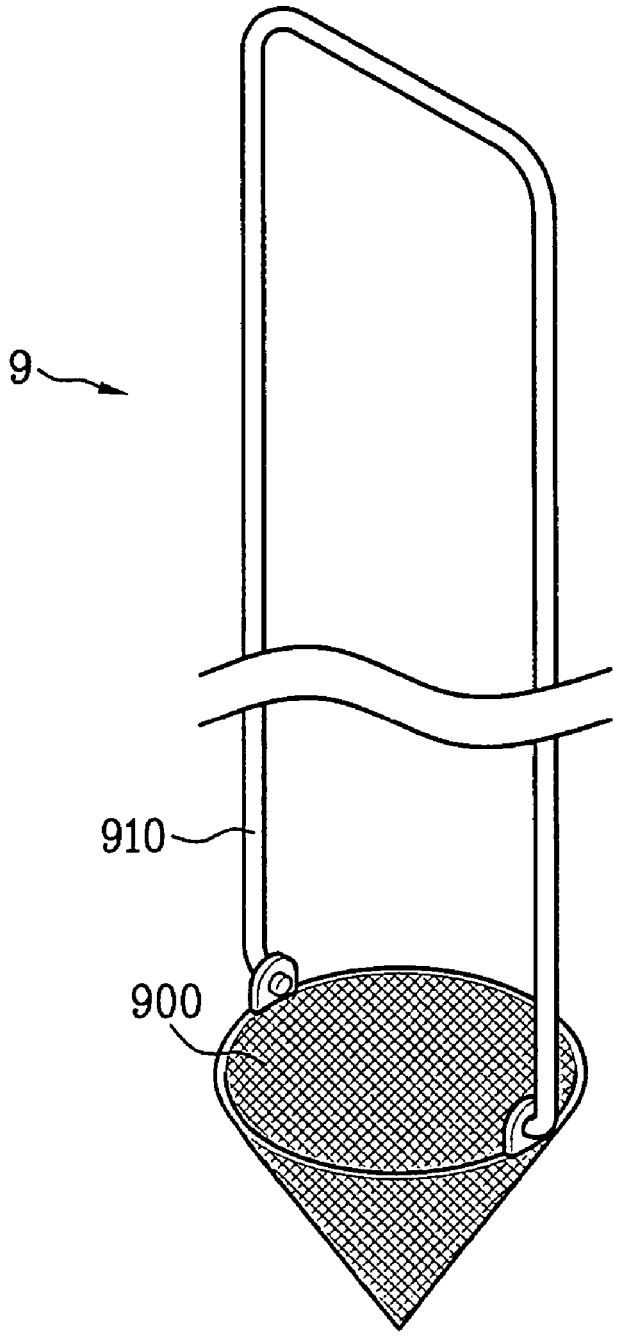
FIG. 9 illustrates a perspective view of a drain filter with a bail applicable to various embodiments of the present invention.

FIG. 3 illustrates a front view of a drum type washing machine in accordance with a first preferred embodiment of the present invention, FIG. 4 illustrates a side section of FIG. 3, and FIG. 9 illustrates a perspective view of a drain filter with a bail applicable to various embodiments of the present invention.

The drum type washing machine in accordance with a first preferred embodiment of the present invention includes an outer case 1, a tub 2 in the outer case 1 having a drain hole 200 at a lowest portion, and an overflow hole 210 at a predetermined position of an upper portion, a drum 3 rotatably mounted in the tub 2, a driving motor 4 which is a power source for transmission of power for rotating the drum through a rotation shaft 400 connected to the drum 3, a filter case 6 of an injection molding separate from the outer case 1 mounted on a front of the outer case so as to be rotatable in a front direction around a lower end, having at least one drain inlet 610 and drain outlet 620, a drain pipe 7 connected between the drain hole 200 in the tub 2 and the filter case 6 for draining water from an inside of the tub 2 toward the filter case 6, a drain valve 8 mounted to control drainage of washed water, rinsed water, extracted water, condensing water in drying from the tub 2 through the drain pipe 7, a drain filter 9 in the filter case 6 under the drain inlet 610, and a drain hose 10 connected to the drain outlet 620 in the filter case 6 for draining water from the filter case to an outside of the washing machine.

The drain filter 9 is mounted in the filter case 6 between the drain inlet 610 and the drain outlet 620.

Particularly, it is preferable that the drain filter 9 is mounted such that a lowest point of the drain filter 9 is positioned higher than a residual water level of a drain path.

The filter case 6 is mounted such that a top end 600 of the filter case 6 is positioned at a point higher than at least 70 cm from a floor on which the drum type washing machine is installed for convenience of handling by a standing user.

The filter case 6 is mounted such that the top end 600 is positioned on an inside of the door so that the top end 600 of the filter case 6 can not be opened if the door is not opened.

The filter case 6 has a pull 640 for handling, preferably at the top end 600 of the filter case 6 positioned on the inside of the door 5.

This is for enabling handling of the filter case 6 in opening the filter case 6 only in a opened state of the door 5.

The drain inlet 610 of the filter case 6 is formed at a point higher than the drain outlet 620.

In the meantime, the filter case 6 may be mounted on a center, or one of opposite sides of a front of the outer case 1.

The drain filter 9 may be a net form of a plastic, or a plastic having a net 900 with a predetermined mesh.

The drain filter 9 has a bail 910 for taking out the filter, having a length enabling the user to hold, and take out the drain filter 9 readily in a state the filter case 6 is opened.

It is preferable that the bail 910 is fastened to a top end of the drain filter 9 with a hinge, which is favorable for detecting mounting of the drain filter 9 at a right position, which will be described later.

In the meantime, at the door 5 or the outer case 1, there is filter case detecting means 11 for detecting mounting of the filter case 6.

It is preferable that a microswitch is mounted as the filter case detecting means 11 for detecting mounting of the filter case 6, so that the microswitch is turned on/off when the door 5 is opened/closed depending on whether the filter case 6 is positioned at a right position or not.

Instead of the contact type microswitch, an optical sensor (not shown) having a light emission unit and a light reception unit may be mounted as the filter case detecting means 11.

At a side of the filter case 6, there is a filter case lock switch assembly 16 for locking/unlocking the filter case 6 under the control of the microcomputer (not shown).

The filter case lock switch assembly 16 has system and operation designed in the same principle with the door lock switch assembly.

That is, the filter case lock switch assembly 16 has a solenoid, a plunger, a return spring, and so on, for moving back and forth depending on application of power to the solenoid, to lock/unlock the filter case 6, and is mounted on the outer case 1 at a side of the filter case 6, or in an inside space of the outer case supported separately.

The filter case lock switch assembly 16 is interlocked with the filter case detecting means 11.

In the meantime, there is detecting means 12 in the filter case 6 for detecting mounting of the drain filter 9.

It is preferable that, as the drain filter detecting means 12, a microswitch is used for turning on/off depending on whether the bail 910 of the drain filter 9 is at a right position or not, to indicate mounting of the drain filter 9 to a microcomputer.

In the meantime, instead of the contact type microswitch, an optical sensor (not shown) having a light emission part and a light reception part may also be used as the drain filter detecting means 12.

Between one side of the filter case 6 and a fixing portion on an inside of the outer case 1, there is an elastic member 13 for giving a return force to the filter case 6 to open/close the filter case 6 with a lower force readily. As the elastic member 13, though it is preferable to use a tension spring for returning the filter case 6 to a closed state automatically, the elastic member 13 is not limited to this.

For an example, as the elastic member 13, a torsion spring may be used, one end of which is secured to the hinge where the lower end of the filter case 6 is mounted thereon.

That is, though not shown, if one end of the torsion spring inserted in a hinge shaft 650 is held at the fixed hinge, and the other end of the torsion spring is held at one side of the filter case 6 which is rotatably mounted, alike the tension spring, the torsion spring gives a return force in an opening, or closing direction to the filter case.

Particularly, by mounting a hinge assembly, the lower end of the filter case 6 is rotatably mounted thereon, on the hinge portion, having a torsion spring, a tension adjusting spring washer, a lock nut, and so on, the filter case 6 may be made to stop at a user's stop position by providing a predetermined torque to the hinge portion.

In this case, a torsional moment on the hinge shaft 650, of gravity of the filter case 6 when the filter case 6 is opening, becomes the same with the torsional moment of the torsion spring on the hinge shaft 650 of the hinge portion, such that moments by forces on the hinge portion of the filter case 6 are always balanced in overall.

In the meantime, at least an end portion of the drain pipe 7 connected to the drain inlet 610 of the filter case 6 is constructed of bellows for allowing extension and contraction following rotation of the filter case 6, to minimize a length of the drain pipe 7 while allowing rotation of the filter case 6.

Of course, it is preferable that the drain hose 10 connected to the drain outlet 620 of the filter case 6 is also constructed of bellows, the drain hose 10 may not be constructed of the bellows as far as the drain hose 10 is flexible and has a surplus length.

In the meantime, the filter case 6 has a residual water outlet 630 in the vicinity of the lowest point of the filter case 6 for draining residual water, with a plug 14 provided thereto for selective opening/closing of the residual water outlet 630.

Connected between the tub side overflow hole 210 at a predetermined position above the drain hole 200 of the tub 2 and the filter case 6, there is a first overflow hose 19.

Moreover, there is a second overflow hose 20 connected to the overflow hole 210 at the upper end portion of the filter case 6, having one end passed through a bottom of the washing machine.

Of course, the one end of the second overflow hose 20 may be passed though a rear wall of the outer case, and is positioned lower than the filter case side overflow hole 210.

Moreover, though it is preferable that the second overflow hose 20 connected to the filter case side overflow hole 210 at the upper end portion of the filter case 6 is also constructed of bellows for allowing extension and contraction following rotation of the filter case, the second overflow hose 20 may not be constructed of the bellows as far as the second overflow hose 20 is flexible and has a surplus length.

In the meantime, there are hanging springs 21 between the outer case 1 and the tub 2 for hanging the tub 2 from an inside of the outer case 1, and there are dampers 22 at predetermined positions of a lower portion of the tub 2 for damping vibration of the tub.

It is preferable that the damper 22 is a friction damper for damping the vibration with a friction force generated as a length thereof varies in an axis direction when the vibration occurs.

The operation of the drum type washing machine will be described.

In washing, rinsing, or spinning, the operation of the driving motor 4 and the drum 3 are performed under the same principle with a related art direct coupling drum type washing machine.

However, the drum type washing machine of the present invention has difference in a draining step of the washing, rinsing, or the spinning, i.e., in a mounting/dismounting structure, and an operation principle of the drain filter 9 for filtering foreign matters from the washing water.

In the draining step, if the drain valve 8 is opened, the water held in the tub 2 is introduced into the filter case through the drain inlet 610 in the filter case 6 via the drain pipe 7.

Then, the washing water is drained through the drain hose 10 from the filter case 6 via the drain filter 9 between the drain inlet 610 and the drain outlet 620.

It is preferable that the lowest point of the drain filter 9 is positioned at a point higher than a residual water level in a drain path. This is because there may be an offensive odor from the residual water due to soil at the drain filter if the drain filter 9 is submerged in the residual water which is held for a excessively long time.

However, of course, the lowest point of the drain filter 9 is required to be positioned at a point higher than a residual water level without exception, and this so even more, if the residual water outlet 630 is provided as described later.

That is, according to the embodiment, the residual water outlet 630 and the plug 4 for selective opening/closing of the residual water outlet 630 on a lower side of the front or a side of the filter case 6, for draining residual water to an outside of the washing machine, permits to prevent a phenomenon caused by decomposition of the residual water from occurring in advance, and solve problems caused by freeze of the residual water in mid-winter, such as breaking the filter case 6 or draining the water, improperly.

Moreover, if water rises higher than a predetermined level in the tub 2 due to continuous water supply by a faulty water supply unit, or the like, the drum type washing machine of the embodiment, with the first overflow hose 19 connected between the tub side overflow hole 210 at the predetermined position above the drain hole 200 of the tub 2 and the filter case 6, drains the water to an outside of the washing machine through the overflow hole 210, thereby permitting to prevent electric components in the drum type washing machine from being wet with the overflowed water to cause problems, effectively.

In solving the problems accompanied with the overflow, of course, it is required that the end of the drain hose 10 is positioned lower than the overflow hole 210.

In the meantime, as the drum type washing machine of the present invention has the top end 600 of the filter case 6 positioned at least 70 cm higher than the floor the drum type washing machine is installed thereon, the user can handle the filter case 6 easily while standing on the floor.

That is, the inconvenience of squatting down in dismounting the filter is resolved.

In the meantime, the drum type washing machine of the embodiment has the top end 600 with the pull 640, of the filter case 6, to be positioned on an inside of the door 5 in a state the door 5 is closed, so that the filter case 6 is not pulled forward in a state the door 5 is not opened.

Therefore, in dismounting the drain filter 9, at first the door 5 is opened, to unlock the filter case 6, and the filter case 6 is pulled forward, holding the pull 640 with one hand.

In this instance, the filter case 6 can be opened smoothly owing to an elastic force adjustment of the elastic member 13 for returning of the filter case 6.

Then, the drain filter is taken out holding the bail 910 fastened to the drain filter 9 in a state the filter case 6 is opened.

In the meantime, if the door 5 is opened before opening the filter case 6, the plunger of the filter case lock switch assembly 16 at a side of the filter case 6 moves backward, to unlock the filter case 6.

The filter case lock switch assembly 16 having the solenoid, the plunger, the return spring, and so on, moves back and forth depending on application of power to the solenoid, for locking/unlocking the filter case 6.

It is preferable that the filter case lock switch assembly 16 is interlocked with the filter case detecting means 11.

That is, the microswitch turns on/off depending on whether the filter case 6 is at a right position or not, and the filter case lock switch assembly 16 locks/unlocks the filter case 6 interlocked with the switching operation of the microswitch.

In the meantime, as the filter case detecting means 11, as described before, instead of the contact type microswitch, an optical sensor (not shown) having a light emission part and a light reception part may be used.

Separate from whether the filter case 6 is opened or not, when the drain filter 9 is taken out, the taken out of the drain filter 9 is detected with the drain filter detecting mean 12 mounted in the filter case 6 for detecting whether the filter is mounted or not, and a detection signal thereof is provided to the microcomputer.

That is, the bail 910 of the drain filter 9 presses the microswitch, one of the drain filter detecting means 12, to turn on, or off the microswitch, and, then, the microcomputer takes this as the taken out of the drain filter 9.

Because it is liable that foreign matters in waste washing water, such as fluffs, buttons, metal pins, rubber bands, and jewelries introduced by mistake, are not filtered, but discharged as they are if the filter case 6 and the door 5 are closed in a state the drain filter 9 is not mounted on the filter case 6, such a drain filter detecting means 12 is required for preventing the filter case 6 or the door 5 from closing, or, even if closed, preventing from locking, and instead, sounding an alarm, or displaying an error state on a display in a state if it is determined that the drain filter 9 is not mounted as the bail 910 of the drain filter 9 does not press the microswitch, so that the user notices this, and prevents operation from progressing without the drain filter 9.

In short, the filter case lock switch assembly 16 can not lock the filter case 6, or the door lock switch assembly 15 can not lock the door 5 in a state it is determined that the drain filter 9 is not mounted, and according to this, the operation of the washing machine stops.

What prevents the filter case 6 from being locked is achieved by the control of the microcomputer to prevent the filter case lock switch assembly 16 from locking the filter case, and what prevents the door 5 from being locked is achieved by the control of the microcomputer to prevent the door lock switch assembly 15 from locking the door.

In the meantime, opposite to above, if the drain filter 9 and the filter case 6 are positioned at right positions, and it is determined that the drain filter 9 and the filter case 6 are positioned at right positions by the drain filter detecting means 12 and the filter case detecting means 11, the filter case lock switch assembly 16 and the door lock switch assembly 15 lock the filter case 6 and the door 5, respectively.

Instead of the contact type microswitch, an optical sensor (not shown) in which whether a light from a light emission part reaches to a light reception part or not is detected may also be used as the drain filter detecting means 12, too.

In the meantime, referring to FIG. 9, with regard to a structure of the drain filter 9, it is preferable that the drain filter 9 may be a net form of a plastic, or a plastic having a net 900 with a predetermined mesh, with the bail 910 rotatably hinged at a top end of the plastic.

Of course, any geometric shape of the drain filter 9 is applicable as far as a function of filtering foreign matters is secured positively regardless of the geometric shape, such as a hollow cylinder, a cone, or a rectangular column.

Different from the related art in which the user squats down inconveniently to take out the filter in cleaning the filter, the user can take out the drain filter 9 easily while standing on a floor, the drum type washing machine of the present invention provides convenience to the user.

Along with this, the drum type washing machine of the present invention, having a height of the drum 3 become higher than the related art drum type washing machine owing to the elongated filter case 6, permits the user to take out or introduce laundry just by stretching a hand without bending.

Figure 5:
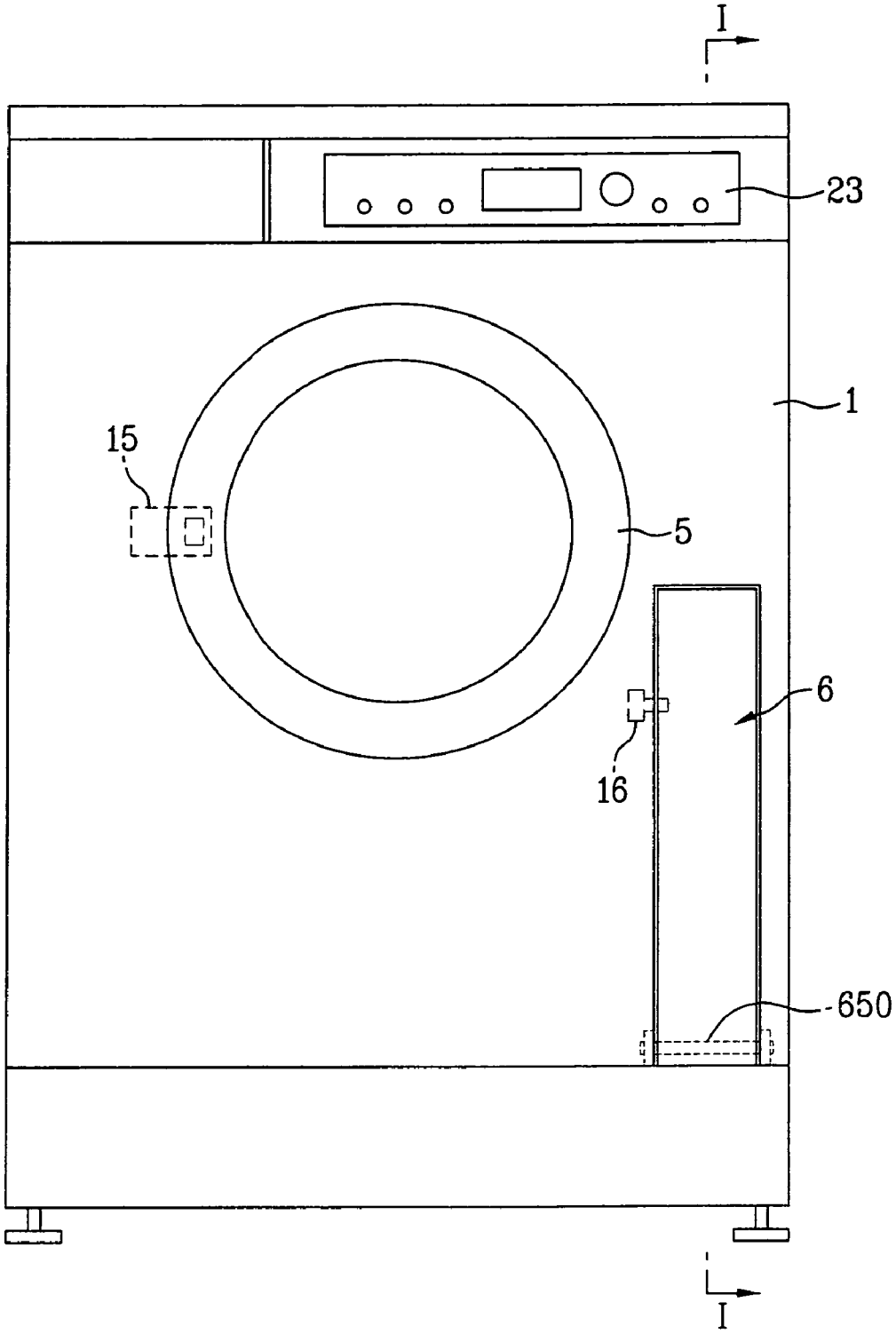
FIG. 5 illustrates a front view of a drum type washing machine in accordance with a second preferred embodiment of the present invention.
Figure 6:
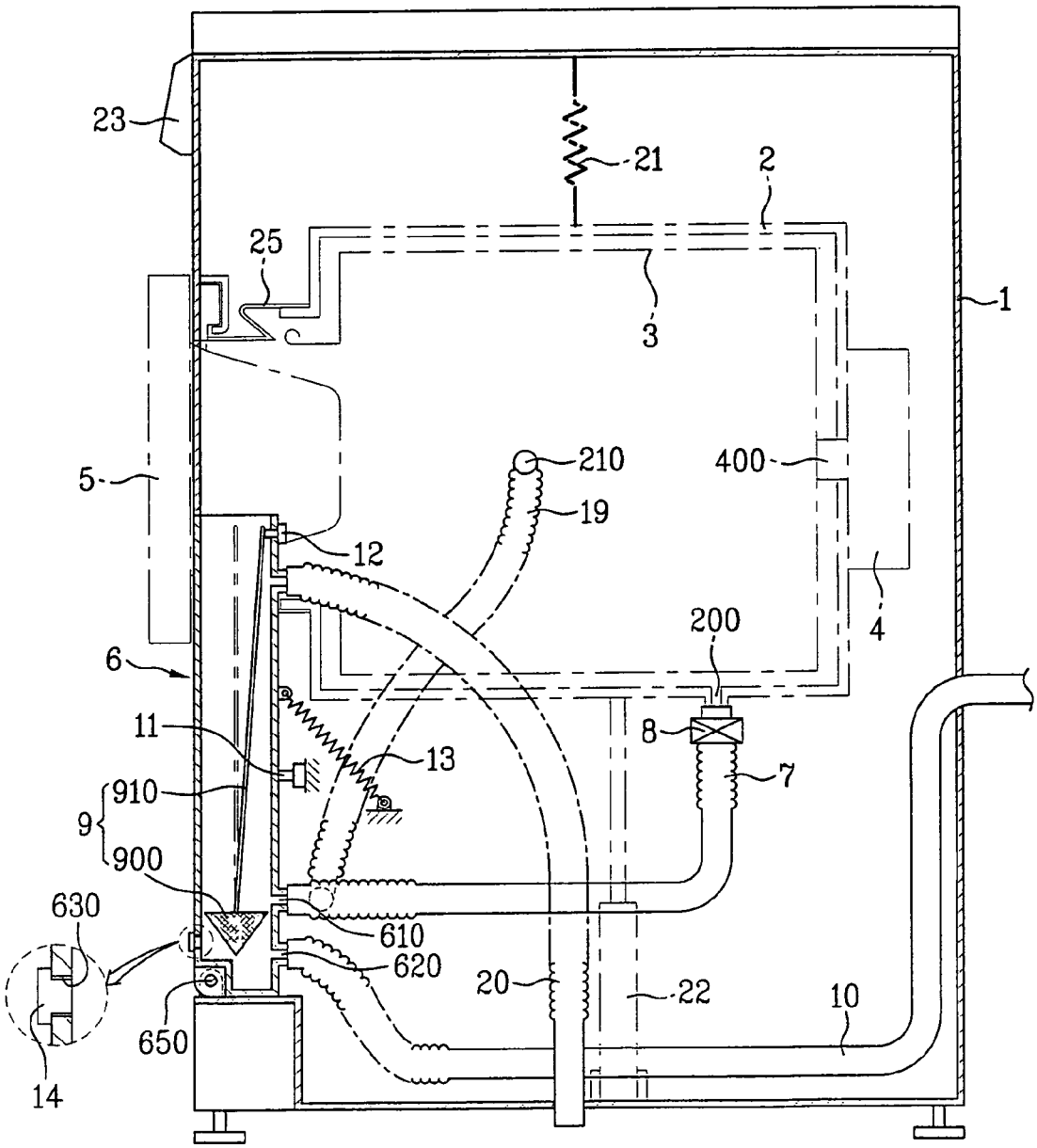
FIG. 6 illustrates a side section of FIG. 5.

In the meantime, FIG. 5 illustrates a front view of a drum type washing machine in accordance with a second preferred embodiment of the present invention, and FIG. 6 illustrates a side section across a line I-I in FIG. 5, which is almost same with the first embodiment, with a few exceptions.

First, different from the first embodiment, the second embodiment shows that a tub 2 and a drum 3 are not tilted.

Moreover, different from the first embodiment, the second embodiment shows that a door side of the front of the outer case 1 is not sloped.

Furthermore, different from the first embodiment, the second embodiment shows that the filter case 6 is mounted spaced away from the door 5.

Though not shown, the filter case 6 may be projected from the front surface of the outer case, to change an outer appearance of the washing machine.

Figure 7:
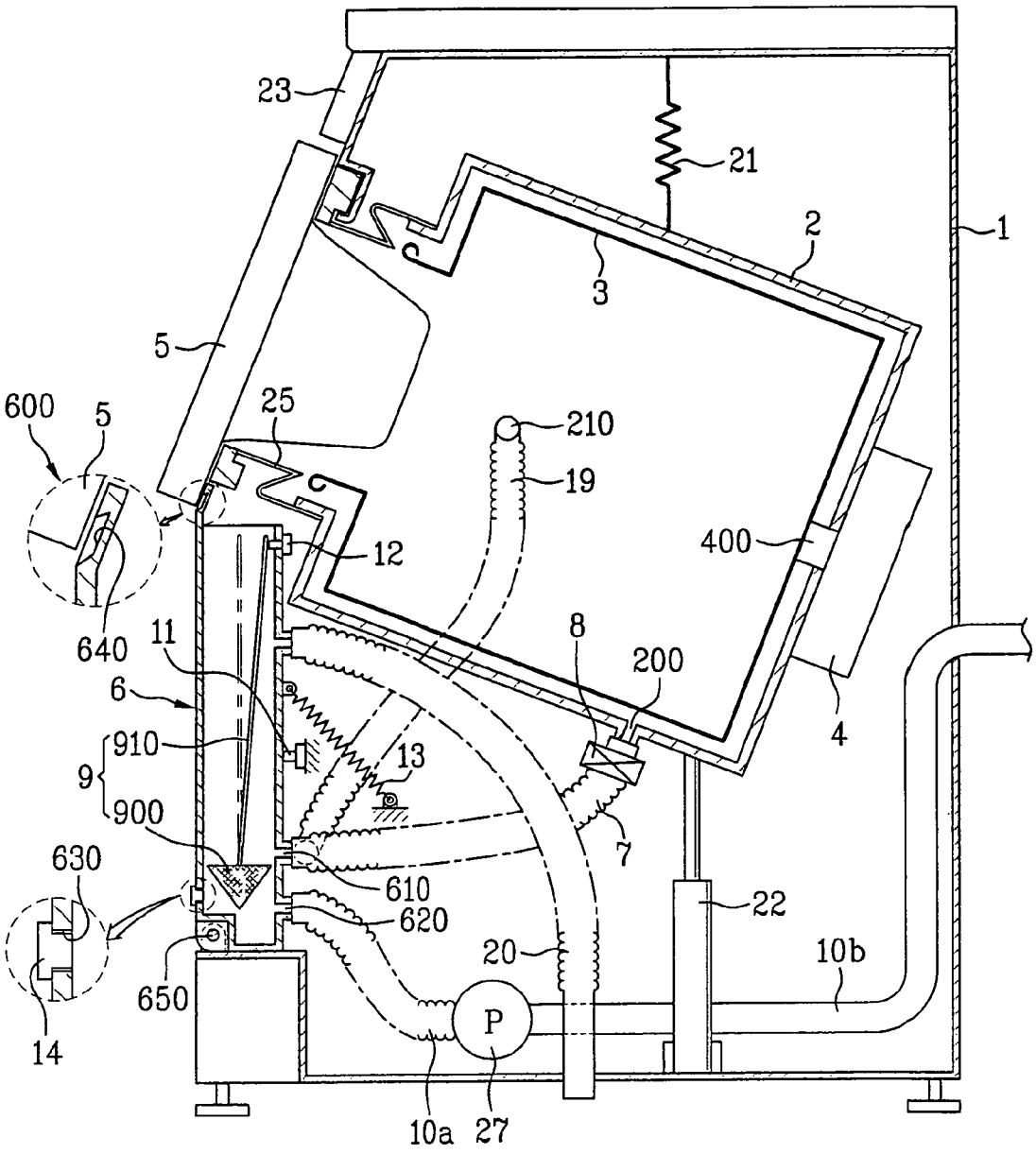
FIG. 7 illustrates a side section of a drum type washing machine in accordance with a third preferred embodiment of the present invention.

Hereinafter, drum type washing machines in accordance with third, and fourth embodiments of the present invention will be described with reference to FIGS. 7, 8, and 9.

The drum type washing machine in accordance with a third preferred embodiment of the present invention includes an outer case 1, a tub 2 in the outer case 1 having a drain hole 200 at a lowest portion, and an overflow hole 210 at a predetermined position of an upper portion, a drum 3 rotatably mounted in the tub 2, a driving motor 4 which is a power source for transmission of power for rotating the drum through a rotation shaft 400 connected to the drum 3, a filter case 6 of an injection molding separate from the outer case 1 mounted on a front of the outer case so as to be rotatable in a front direction around a lower end, having at least one drain inlet 610 and drain outlet 620, a drain pipe 7 connected between the drain hole 200 in the tub 2 and the filter case 6 for draining water from an inside of the tub 2 toward the filter case 6, a drain valve 8 mounted to control drainage of washed water, rinsed water, extracted water, condensing water in drying from the tub 2 through the drain pipe 7, a drain filter 9 in the filter case 6 between the drain inlet 610 and the drain outlet 620, a pump drain hose 10*a* connected to the drain outlet 620 in the filter case 6, a drain pump 27 connected to the pump drain hose 10*a* for pumping water from the filter case to an outside of the washing machine, and an external drain hose 10*b* for discharging the water pumped by the drain pump 27 to an outside of the washing machine.

It is preferable that the drain filter 9 is mounted such that a lowest point of the drain filter 9 is positioned higher than a residual water level of a drain path.

The filter case 6 is mounted such that a top end 600 of the filter case 6 is positioned at a point higher than at least 70 cm from a floor on which the drum type washing machine is installed for handling by a user standing of the floor.

The filter case 6 is mounted such that the top end 600 is positioned on an inside of the door so that the top end 600 of the filter case 6 can not be opened as far as the door is not opened.

The filter case 6 has a pull 640 for handling, preferably at the top end 600 of the filter case 6 positioned on the inside of the door 5, in a form of a recess, or a separate component fabricated separately and mounted thereon.

This is for enabling handling of the filter case 6 in opening the filter case 6 only in an opened state of the door 5.

The drain inlet 610 of the filter case 6 is formed at a point higher than the drain outlet 620.

In the meantime, the filter case 6 may be mounted on a center, or one of opposite sides of a front of the outer case 1.

The drain filter 9 may be a net form of a plastic, or a plastic having a net 900 with a predetermined mesh.

The drain filter 9 has a bail 910 for taking out the filter, having a length enabling the user to hold, and take out the drain filter 9 readily in a state the filter case 6 is opened.

It is preferable that the bail 910 is fastened to a top end of the drain filter 9 with a hinge, which is favorable for detecting mounting of the drain filter 9 at a right position, which will be described later.

In the meantime, at the door 5 or the outer case 1, there is filter case detecting means 11 for detecting mounting of the filter case 6.

It is preferable that a microswitch is mounted as the filter case detecting means 11 for detecting mounting of the filter case 6, so that the microswitch is turned on/off when the door 5 is opened/closed depending on whether the filter case 6 is positioned at a right position or not.

In the meantime, instead of the contact type microswitch, an optical sensor (not shown) having a light emission unit and a light reception unit may be mounted as the filter case detecting means 11.

At a side of the filter case 6, there is a filter case lock switch assembly 16 for locking/unlocking the filter case 6 under the control of the microcomputer.

The filter case lock switch assembly 16 has system and operation designed in the same principle with the door lock switch assembly 15.

That is, the filter case lock switch assembly 16 has a solenoid, a plunger, a return spring, and so on, for moving back and forth depending on application of power to the solenoid, to lock/unlock the filter case 6, and is mounted on the outer case 1 at a side of the filter case 6, or in an inside space of the outer case supported, separately.

The filter case lock switch assembly 16 is interlocked with the filter case detecting means 11.

In the meantime, there is drain filter detecting means 12 in the filter case 6 for detecting mounting of the drain filter 9.

It is preferable that, as the drain filter detecting means 12, a microswitch is used for turning on/off depending on whether the bail 910 of the drain filter 9 is at a right position or not, to indicate mounting of the drain filter 9 to a microcomputer.

In the meantime, instead of the contact type microswitch, an optical sensor (not shown) having a light emission part and a light reception part may also be used as the drain filter detecting means 12.

Between one side of the filter case 6 and a fixing portion on an inside of the outer case 1, there is an elastic member 13 for automatic returning of the filter case 6. As the elastic member 13, though it is preferable to use a tension spring for returning the filter case 6 to a closed state automatically, the elastic member 13 is not limited to this.

For an example, as the elastic member 13, a torsion spring may be used, one end of which is secured to the hinge where the lower end of the filter case 6 is mounted thereon.

That is, if one end of the torsion spring inserted in a hinge shaft 650 is held at the fixed hinge, and the other end of the torsion spring is held at one side of the filter case 6 which is rotatably mounted, the torsion spring can perform the same work with the tension spring.

Particularly, by mounting a hinge assembly, the lower end of the filter case 6 is rotatably mounted thereon, on the hinge portion, having a torsion spring, a tension adjusting spring washer, a lock nut, and so on, the filter case 6 may be made to stop at a user's stop position by providing a predetermined torque to the hinge portion.

In this case, a torsional moment on the hinge shaft 650, of gravity of the filter case 6 when the filter case 6 is opening, becomes the same with the torsional moment of the torsion spring on the hinge shaft 650 of the hinge portion, such that moments by forces on the hinge portion of the filter case 6 are always balanced in overall.

In the meantime, at least an end portion of the drain pipe 7 connected to the drain inlet 610 of the filter case 6 is constructed of bellows for allowing extension and contraction following rotation of the filter case 6, to minimize a length of the drain pipe 7 while allowing rotation of the filter case 6.

Of course, it is preferable that the pump drain hose 10*a* connected to the drain outlet 620 of the filter case 6 is also constructed of bellows.

In the meantime, the filter case 6 has a residual water outlet 630 in the vicinity of the lowest point of the filter case 6 for draining residual water, with a plug 14 for selective opening/closing of the residual water outlet 630.

Connected between the tub side overflow hole 210 at a predetermined position above the drain hole 200 of the tub 2 and the filter case 6, there is a first overflow hose 19.

There is a second overflow hose 20 connected to the overflow hole 210 at the upper end portion of the filter case 6, having one end passed through a bottom of the washing machine.

Of course, the one end of the second overflow hose 20 may be passed though a rear wall of the outer case, and is positioned lower than the filter case side overflow hole 210.

Moreover, though it is preferable that the second overflow hose 20 connected to the filter case side overflow hole 210 at the upper end portion of the filter case 6 is also constructed of bellows for allowing extension and contraction following rotation of the filter case, the second overflow hose 20 may not be constructed of the bellows as far as the second overflow hose 20 is flexible and has a surplus length.

In the meantime, there are hanging springs 21 between the outer case 1 and the tub 2 for hanging the tub 2 from an inside of the outer case 1, and there are dampers 22 at predetermined positions of a lower portion of the tub 2 for damping vibration of the tub.

It is preferable that the damper 22 is a friction damper for damping the vibration with a friction force generated as a length thereof varies in an axis direction when the vibration occurs.

The operation of the drum type washing machine in accordance with the third preferred embodiment of the present invention will be described.

In washing, rinsing, or spinning, the operation of the driving motor 4 and the drum 3 are performed under the same principle with a related art direct coupling drum type washing machine.

However, the drum type washing machine of the present invention has difference in a draining step of the washing, rinsing, or the spinning, i.e., in a mounting/dismounting structure, and an operation principle of the drain filter 9 for filtering foreign matters from the washing water.

In the draining step, if the drain valve 8 is opened in a state the drain pump 27 is in operation, the water held in the tub 2 is introduced into the filter case through the drain inlet 610 in the filter case 6 via the drain pipe 7.

Then, the washing water is drained through the drain hose 10 from the filter case 6 via the drain filter 9 between the drain inlet 610 and the drain outlet 620.

The washing water introduced to the pump drain hose 10*a* is forcibly discharged through the external drain hose 10*b* by pumping of the drain pump 27.

Accordingly, when the drain pump 27 is in operation, the draining operation can be made normally even if the external drain hose 10*b* is positioned higher than the overflow hole 210.

It is preferable that the lowest point of the drain filter 9 is positioned at a point higher than a residual water level in a drain path. This is because there may be an offensive odor from the residual water due to soil at the drain filter if the drain filter 9 is submerged in the residual water which is held for a excessively long time.

However, of course, the lowest point of the drain filter 9 is required to be positioned at a point higher than a residual water level without exception, and this so even more, if the residual water outlet 630 is provided as described later.

That is, according to the embodiment, the residual water outlet 630 and the plug 4 for selective opening/closing of the residual water outlet 630 on a lower side of the front or a side of the filter case 6, for draining residual water to an outside of the washing machine, permits to prevent a phenomenon caused by decomposition of the residual water from occurring in advance, and solve problems caused by freeze of the residual water in mid-winter, such as breaking the filter case 6 or draining the water, improperly.

Moreover, if water rises higher than a predetermined level in the tub 2 due to continuous water supply by a faulty water supply unit, or the like, the drum type washing machine of the embodiment, with the first overflow hose 19 connected between the tub side overflow hole 210 at the predetermined position above the drain hole 200 of the tub 2 and the filter case 6, drains the water to an outside of the washing machine through the overflow hole 210, thereby permitting to prevent electric components in the drum type washing machine from being wet with the overflowed water to cause problems, effectively.

In preventing the overflow, of course, it is required that the end of the drain hose 10 is positioned lower than the overflow hole 210.

In the meantime, as the drum type washing machine of the present invention has the top end 600 of the filter case 6 positioned at least 70 cm higher than the floor the drum type washing machine is installed thereon, the user can handle the filter case 6 easily while standing on the floor.

That is, the inconvenience of squatting down in dismounting the filter is resolved.

In the meantime, the drum type washing machine of the embodiment has the top end 600 with the pull 640, of the filter case 6, to be positioned on an inside of the door 5 in a state the door 5 is closed, so that the filter case 6 is not pulled forward in a state the door 5 is not opened.

Therefore, in dismounting the drain filter 9, at first the door 5 is opened, to unlock the filter case 6, and the filter case 6 is pulled forward, holding the pull 640 with one hand.

In this instance, the filter case 6 can be opened smoothly owing to an elastic force adjustment of the elastic member 13 for returning of the filter case 6.

Then, the drain filter is taken out holding the bail 910 fastened to the drain filter 9 in a state the filter case 6 is opened.

In the meantime, if the door 5 is opened before opening the filter case 6, the plunger of the filter case lock switch assembly 16 at a side of the filter case 6 moves backward, to unlock the filter case 6.

The filter case lock switch assembly having the solenoid, the plunger, the return spring, and so on, moves back and forth depending on application of power to the solenoid, for locking/unlocking the filter case 6.

It is preferable that the filter case lock switch assembly is interlocked with the filter case detecting means 11.

That is, the microswitch turns on/off depending on whether the filter case 6 is at a right position or not, and the filter case lock switch assembly 16 locks/unlocks the filter case 6 interlocked with the switching operation of the microswitch.

In the meantime, as the filter case detecting means 11, as described before, instead of the contact type microswitch, an optical sensor (not shown) having a light emission part and a light reception part may be used.

Separate from whether the filter case 6 is opened or not, when the drain filter 9 is taken out, the taken out of the drain filter 9 is detected with the drain filter detecting mean 12 mounted in the filter case 6 for detecting whether the filter is mounted or not, and a detection signal thereof is provided to the microcomputer.

That is, when the user holds the bail 910 of the drain filter 9, the microswitch pressed down by the bail 910 is opened, and then, the microcomputer takes this as the taken out of the drain filter 9.

Because it is liable that foreign matters in waste washing water, such as fluffs, buttons, metal pins, and rubber bands, are not filtered, but introduced into the drain pump 27 to hold the impeller, or cause the pump to be out of order, if the filter case 6 and the door 5 are closed, and washing, spinning, and so on are progressed as they are in a state the drain filter 9 is not mounted on the filter case 6, such a drain filter detecting means 12 is required for preventing the filter case 6 or the door 5 from closing, or, even if closed, preventing from locking, and instead, sounding an alarm, or displaying an error state on a display in a state if it is determined that the drain filter 9 is not mounted as the bail 910 of the drain filter 9 does not press the microswitch, so that the user notices this, and prevents operation from progressing without the drain filter 9.

In short, the filter case lock switch assembly 16 can not lock the filter case 6, or the door lock switch assembly 15 can not lock the door 5 in a state it is determined that the drain filter 9 is not mounted, and according to this, the operation of the washing machine stops.

What prevents the filter case 6 from being locked is achieved by the control of the microcomputer to prevent the filter case lock switch assembly 16 from locking the filter case, and what prevents the door 5 from being locked is achieved by the control of the microcomputer to prevent the door lock switch assembly 15 from locking the door.

In the meantime, opposite to above, if the drain filter 9 and the filter case 6 are positioned at right positions, and it is determined that the drain filter 9 and the filter case 6 are positioned at right positions by the drain filter detecting means 12 and the filter case detecting means 11, the filter case lock switch assembly 16 and the door lock switch assembly 15 lock the filter case 6 and the door 5, respectively.

Instead of the contact type microswitch, an optical sensor (not shown) in which whether a light from a light emission part reaches to a light reception part or not is detected may also be used as the drain filter detecting means 12, too.

In the meantime, referring to FIG. 9, with regard to a structure of the drain filter 9, it is preferable that the drain filter 9 may be a net form of a plastic, or a plastic having a net 900 with a predetermined mesh, with the bail 910 rotatably hinged at a top end of the plastic, as described in the first, and second embodiments.

Of course, any geometric shape of the drain filter 9 is applicable as far as a function of filtering foreign matters is secured positively regardless of the geometric shape, such as a hollow cylinder, a cone, or a rectangular column.

Different from the related art in which the user squats down inconveniently to take out the filter in cleaning the filter, the user can take out the drain filter 9 easily while standing on a floor, the drum type washing machine of the present invention provides convenience to the user.

Along with this, the drum type washing machine of the present invention, having a height of the drum 3 become higher than the related art drum type washing machine owing to the elongated filter case 6, permits the user to take out or introduce laundry just by stretching a hand without bending.

Figure 8:
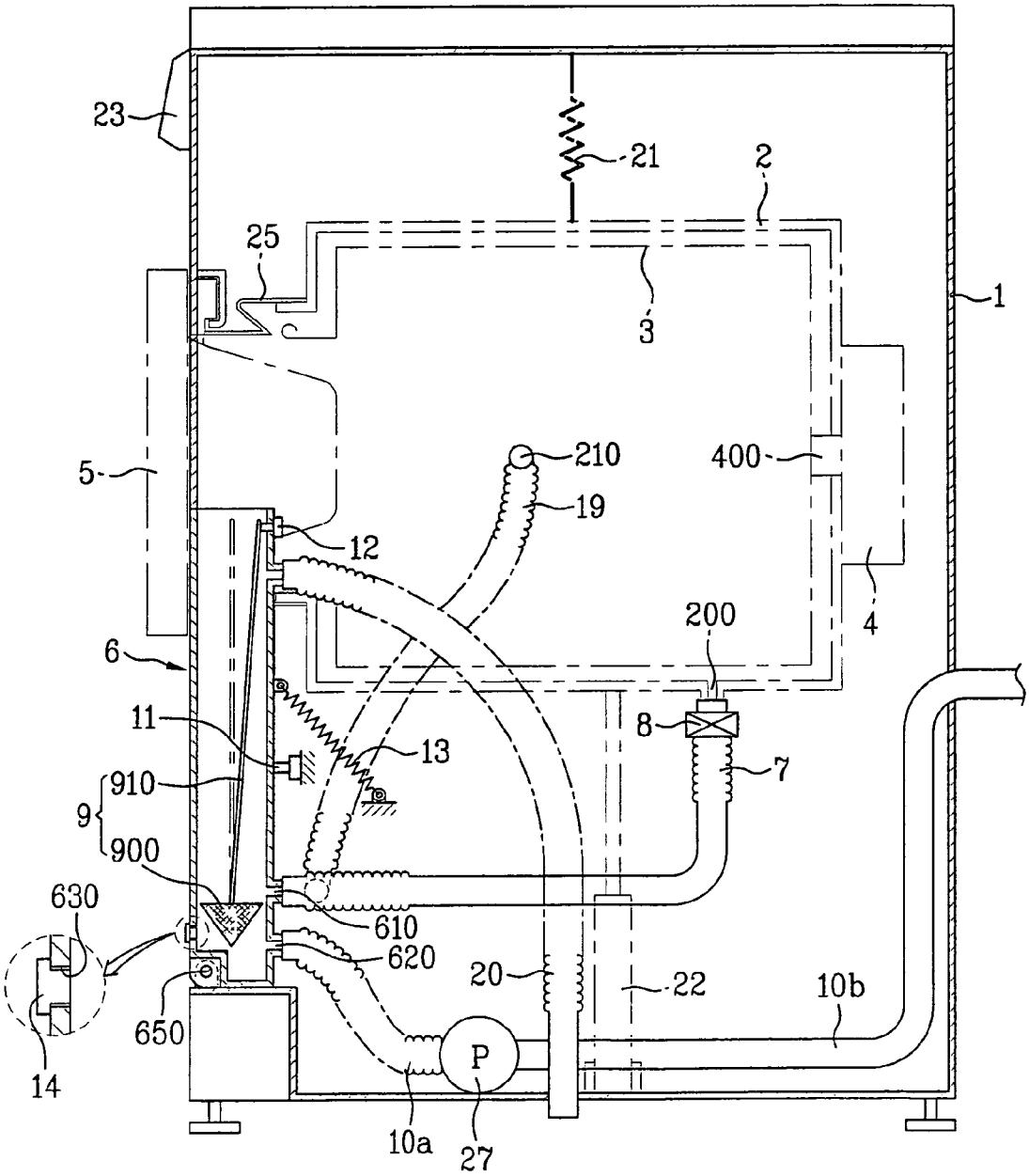
FIG. 8 illustrates a side section of a drum type washing machine in accordance with a fourth preferred embodiment of the present invention.

In the meantime, FIG. 8 illustrates a side section of a drum type washing machine in accordance with a fourth preferred embodiment of the present invention, having a similar system with the third embodiment except a few points.

At first, different from the third embodiment, in the embodiment, the tub 2 and the drum 3 are not tilted.

Moreover, different from the third embodiment, a door side of a front of the outer case 1 has no slope.

Furthermore, different from the third embodiment, the filter case 6 is mounted spaced away from the door 5.

In this case, a space to spare for changing a height of the filter case 6 becomes greater compared to the third embodiment, a total height of the filter case 6, or a height of inlet of the filter case can be made higher than the third embodiment.

Though not shown, the filter case 6 may be projected forward from a front surface of the outer case, to change an outer appearance.

In the meantime, although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

For an example, while the bail 910 of the drain filter 9 is, not rotatable, but fixed, a sensor or switch may be provided for detecting whether the drain filter 9 is mounted or not by means of interference with, or approach of the plastic or the bail at the time of mounting the drain filter 9 into the filter case.

Moreover, instead of the electric filter case lock switch assembly 16, locking means may be provided at one side of the filter case 6, for maintaining a locked state of the filter case, mechanically.

The locking means includes a hook 17 on a filter case 6 side, and a hook holding piece 18 on the outer case 1 or inside of the outer case 1 mounted separately in correspondence to the hook 17.

INDUSTRIAL APPLICABILITY

Different from the related art drum type washing machine in which the user is required to squat down for opening the lower filter cap, and taking out the filter, the drum type washing machine of the present invention permits to take out the drain filter standing of a floor, providing convenience of use to the user, a product reliability can be enhanced.

The greater drum height than the related art enabled by the taller filter case permits the user to introduce/take out laundry through the door without bending, but just stretching a hand.

The drum type washing machine of the present invention can solve the problem of damage to electric components caused by overflow of the washing water in a faulty condition, thereby enhancing product reliability.

The possibility of mounting the filter case at a middle, or one of opposite sides of the front of the outer case expands a width of selection from shapes, lengths, and so on of the filter case, and permits to vary an overall outer appearance.

The invention claimed is:

1. A drum type washing machine comprising:

an outer case;

a tub in the outer case having a drain hole at a lowest portion, and an overflow hole at a predetermined position of an upper portion;

a drum rotatably mounted in the tub;

a driving motor for transmission of power for rotating the drum through a rotation shaft connected to the drum;

a filter case vertically mounted at a front portion of the outer case to be exposed to an outside of the washing machine such that a user directly accesses the filter case, wherein the filter case pivots on a lower end thereof hinged on the outer case, toward the outside of the washing machine;

a drain pipe connected between the drain hole in the tub and the filter case configured to drain water from an inside of the tub toward the filter case;

a drain valve mounted to the drain pipe, wherein the drain valve controls a drainage of water from the tub and a supply of the water drained from the tub to the filter case through the drain pipe;

a drain filter disposed between a drain inlet and a drain outlet in the filter case, wherein the filter case contains the drain filter therein and the drain filter pivots along with the filter case toward the outside of the washing machine such that the user directly takes the filter out of the filter case; and a drain hose connected to the drain outlet in the filter case for draining water from the filter case to an outside of the washing machine.

2. The drum type washing machine as claimed in claim 1, wherein the filter case is an injection molding of a material different, and separate from the outer case.

3. The drum type washing machine as claimed in claim 1, wherein the filter case is mounted on the middle of a front thereof.

4. The drum type washing machine as claimed in claim 1, wherein the filter case is mounted on one of opposite sides of the front thereof.

5. The drum type washing machine as claimed in claim 1, wherein the drain filter is mounted such that a lowest point of the drain filter is positioned at a point higher than a residual water level in a drain path.

6. The drum type washing machine as claimed in claim 1, wherein the filter case has a top end positioned at a height at least 70 cm from a bottom of the washing machine.

7. The drum type washing machine as claimed in claim 1, wherein the filter case is mounted such that the top end thereof is positioned on an inside of the door so that the filter case is not opened in a state the door is not opened.

8. The drum type washing machine as claimed in claim 7, wherein the filter case has a handle for opening the filter case, and wherein the door covers the handle of the filter case when the door is closed, such that the user is unable to access the handle to open the filter case while the washing machine is operated.

9. The drum type washing machine as claimed in claim 1, wherein the drain filter is a structure including a net having meshes.

10. The drum type washing machine as claimed in claim 9, wherein the drain filter includes a bail for taking out the filter.

11. The drum type washing machine as claimed in claim 10, wherein the bail is hinged to a top end portion of the drain filter.

12. The drum type washing machine as claimed in claim 1, further comprising filter case detecting means on the door, or the outer case, for detecting whether the filter case is mounted or not.

13. The drum type washing machine as claimed in claim 12, wherein the filter case detecting means is a microswitch for detecting whether the filter case is mounted or not as the microswitch is turned on/off depending on whether the filter case is positioned at a right position or not.

14. The drum type washing machine as claimed in claim 12, wherein the filter case detecting means is an optical sensor for detecting whether the filter case is positioned at a right position or not depending on whether a light reaches from a light emission part to a light reception part or not.

15. The drum type washing machine as claimed in claim 1, further comprising detecting means in the filter case for detecting whether the drain filter is mounted or not.

16. The drum type washing machine as claimed in claim 15, wherein the drain filter detecting means is a microswitch for detecting whether the drain filter is mounted or not as the microswitch is turned on/off depending on whether the bail of the drain filter is positioned at a right position or not.

17. The drum type washing machine as claimed in claim 15, wherein the drain filter detecting means is an optical sensor for detecting whether the filter is mounted or not depending on whether a light reaches from a light emission part to a light reception part or not.

18. The drum type washing machine as claimed in claim 12, further comprising a filter case lock switch assembly mounted on the outer case at a side of the filter case, or in an inside space of the outer case for unlocking the filter case interlocked with the filter case detecting means.

19. The drum type washing machine as claimed in claim 18, wherein the filter case lock switch assembly includes a solenoid, and a plunger for moving back and forth depending on application of power to the solenoid, to lock/unlock the filter case.

20. The drum type washing machine as claimed in claim 1, further comprising an elastic member for automatic returning of the filter case.

21. The drum type washing machine as claimed in claim 20, wherein the elastic member is a tension spring mounted between one side of the filter case and a fixing portion on an inside of the outer case for providing a returning force in an opening or closing direction with respect to the filter case.

22. The drum type washing machine as claimed in claim 20, wherein the elastic member is a torsion spring mounted on a hinge portion at a lower end of the filter case for providing a returning force in an opening or closing direction with respect to the filter case.

23. The drum type washing machine as claimed in claim 1, wherein the drain pipe connected to the drain inlet of the filter case, and the drain hose connected to the drain outlet in the filter case includes bellows which extend and contract following rotation of the filter case.

24. The drum type washing machine as claimed in claim 1, wherein the filter case has a residual water outlet in the vicinity of the lowest point thereof for draining residual water, with a residual water drain plug provided thereto for selective opening/closing.

25. The drum type washing machine as claimed in claim 1, further comprising locking means at one side of the filter case for maintaining a locked state of the filter case.

26. The drum type washing machine as claimed in claim 25, wherein the locking means includes; a hook at the filter case, and a hook holding piece mounted separately at the outer case, or inside of the outer case in correspondence to the hook.

27. The drum type washing machine as claimed in claim 1, further comprising: a first overflow hose connected between a tub side overflow hole at a predetermined position above the drain hole of the tub and the filter case; and a second overflow hose connected to a filter case side overflow hole in an upper portion of the filter case, having one end mounted so as to pass through a bottom, or a rear wall of the outer case and position at a point lower than the filter case side overflow hole.

28. The drum type washing machine as claimed in claim 27, wherein the second overflow hose connected to a filter case side overflow hole in an upper portion of the filter case includes bellows which extend and contract following rotation of the filter case.

29. The drum type washing machine as claimed in claim 1, wherein the filter case is projected toward the outside of the washing machine from a front surface of the outer case.

30. The drum type washing machine as claimed in claim 1, further comprising a drain pump in a flow passage of the drain hose for forced draining.

31. The drum type washing machine as claimed in claim 1, wherein the filter case pivots forward to the outside of the washing machine when the door is opened.

* * * * *